US005438932A

United States Patent [19]

Lipsius et al.

[11] Patent Number: 5,438,932

[45] Date of Patent: Aug. 8, 1995

[54] RUNNING GEAR FOR A RAILBORNE VEHICLE THAT IS RADIALLY ADJUSTABLE THROUGH COMPENSATING LEVERS

[75] Inventors: Johann M. Lipsius; Wolfgang Auer, both of Kassel, Germany

[73] Assignee: ABB Patent GmbH, Mannheim, Germany

[21] Appl. No.: 203,280

[22] Filed: Feb. 28, 1994

[30] Foreign Application Priority Data

Feb. 27, 1993 [DE] Germany ..... 43 06 116.8

[51] Int. Cl.[6] ..... B61F 5/38

[52] U.S. Cl. ..... 105/168

[58] Field of Search ..... 105/168, 167, 218.2

[56] References Cited

U.S. PATENT DOCUMENTS

| | | | |
|---|---|---|---|
| 3,974,779 | 8/1976 | Lindblom et al. | 105/218.2 X |
| 4,300,454 | 11/1981 | Scheffel | 105/168 |
| 4,903,613 | 2/1990 | Lang et al. | 105/168 |
| 5,211,116 | 5/1993 | Schneider | 105/168 |

FOREIGN PATENT DOCUMENTS

| | | | |
|---|---|---|---|
| 0303007 | 2/1989 | European Pat. Off. . | |
| 387744 | 9/1990 | European Pat. Off. | 105/168 |
| 2659797 | 8/1977 | Germany . | |
| 3004082 | 8/1983 | Germany . | |
| 3725574 | 5/1990 | Germany . | |
| 3904203 | 8/1990 | Germany . | |
| 3827412 | 1/1991 | Germany . | |
| 90/02068 | 3/1990 | WIPO . | |

*Primary Examiner*—Robert J. Oberleitner
*Assistant Examiner*—S. Joseph Morano
*Attorney, Agent, or Firm*—Herbert L. Lerner; Laurence A. Greenberg

[57] ABSTRACT

A railborne vehicle has at least two wheelsets. A running gear includes compensating levers for coupling the at least two wheelsets and includes wheelset bearings/axle bearing housings. Guide rod configurations are disposed between the wheelset bearings/axle bearing housings and the compensating levers for radial adjustability. At least one damping element is disposed between one of the compensating levers and one of the guide rod configurations.

6 Claims, 2 Drawing Sheets

RUNNING GEAR FOR A RAILBORNE VEHICLE THAT IS RADIALLY ADJUSTABLE THROUGH COMPENSATING LEVERS

BACKGROUND OF THE INVENTION

Field of the Invention

The invention relates to a running gear or undercarriage for a railborne vehicle which can be used with railroad locomotives as well as non-driven vehicles and which has at least two wheelsets with radial adjustability by means of guide rod configurations between wheelset bearings/axle bearing housings and compensating levers for coupling the two wheelsets.

Such a running gear for a railborne vehicle that is radially adjustable through compensating levers is known from German Patent DE 38 27 412 C2. The general disadvantage of radial control is that it lessens running stability, because of a requisite relative mobility among the wheelset bearings. Damping between the wheelset bearings or the wheelsets is therefore generally proposed, such as in German Published, Non-Prosecuted Applications DE-OS 26 59 797 and DE 39 04 203 A1. The effect and structural volume of the damping members are highly dependent on the installed disposition of the damping members.

SUMMARY OF THE INVENTION

It is accordingly an object of the invention to provide a running gear for a railborne vehicle that is radially adjustable through compensating levers, which overcomes the hereinafore-mentioned disadvantages of the heretofore-known devices of this general type and which exhibits optimal damping of a motion of wheelset bearings relative to one another.

With the foregoing and other objects in view there is provided, in accordance with the invention, in a railborne vehicle having at least two wheelsets, a running gear, comprising compensating levers for coupling the at least two wheelsets; wheelset bearings/axle bearing housings; guide rod configurations disposed between the wheelset bearings/axle bearing housings and the compensating levers for radial adjustability; and at least one damping element disposed between one of the compensating levers and one of the guide rod configurations.

The advantages attainable with the invention are in particular that, by utilizing lever ratios existing between the compensating levers and the wheelset guide rods or the connecting guide rods, damping elements of relatively small structural volume, for instance with a friction characteristic, can be used. This is structurally advantageous and does not substantially increase the weight of the unsprung masses.

The motion of the wheelset bearings relative to one another that is effected by the radial control, is damped. Vibration in the wheel set axles resulting from track defects is effectively damped or even completely prevented up to a predeterminable limit value, since motion between the wheelset bearings can be completely suppressed up to a predeterminable longitudinal force level because of the predetermined damping characteristic, for instance the pronounced friction characteristic, so that unnecessary wear does not occur at the wheels and rails, and the running stability of the railborne vehicle is increased.

In accordance with another feature of the invention, the guide rod configurations each have one respective wheelset guide rod between the wheelset bearings/axle bearing housings and the compensating levers, and the at least one damping element is disposed between one of the compensating levers and the wheelset guide rod.

In accordance with a further feature of the invention, the vehicle has truck frames, the guide rod configurations have a tandem construction with wheelset guide rods between the wheelset bearings/axle bearing housings and the truck frames as well as connecting guide rods between the wheelset guide rods and the compensating levers, and the at least one damping element is disposed between one of the compensating levers and one of the connecting guide rods.

In accordance with an added feature of the invention, the vehicle has a truck with right and left sides at which the damping elements are disposed, and the at least one damping element is damping elements on the right and left sides of the truck acting in opposite directions.

In accordance with an additional feature of the invention, the at least one damping element has a friction characteristic.

In accordance with a concomitant feature of the invention, the at least one damping element has a force limitation.

Other features which are considered as characteristic for the invention are set forth in the appended claims.

Although the invention is illustrated and described herein as embodied in a running gear for a railborne vehicle that is radially adjustable through compensating levers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
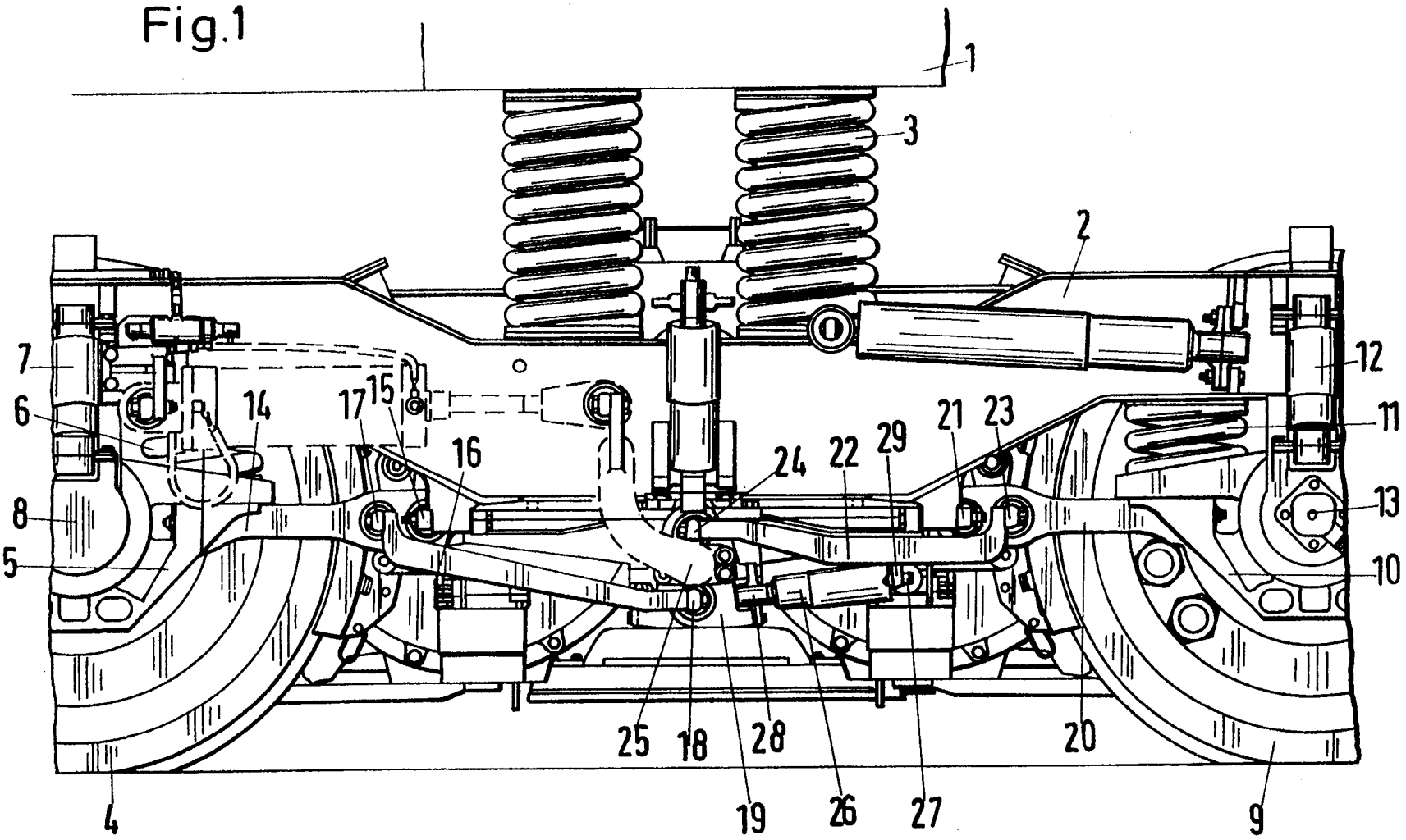
FIG. 1 is a fragmentary, diagrammatic, side-elevational view of a running gear for a railborne vehicle that is radially adjustable through compensating levers with a tandem structure for a wheelset guide rod/connecting guide rod.

Referring now to the figures of the drawing in detail and first, particularly, to FIG. 1 thereof, there is seen a running gear or undercarriage for a railborne vehicle that is radially adjustable through compensating levers with a tandem structure of a wheelset guide rod/connecting guide rod. A bogie or truck frame 2 is suspended from a car box 1 of a railborne vehicle. Spring elements 3 serve to provide suspension for the car box 1. Two wheel sets are suspended from the bogie or truck frame 2. A first wheel 4 of a first wheelset and a first wheel 9 of a second wheelset can be seen. An axle bearing housing 5 with a wheelset bearing of the first wheel 4 of the first wheelset is supported on the bogie or truck frame 2 through wheelset spring elements 6 and wheelset damping elements 7. A first wheelset axle is indicated by reference numeral 8.

An axle bearing housing 10 with a wheelset bearing of the first wheel 9 of the second wheelset is supported in the same manner on the bogie or truck frame 2 through wheelset spring elements 11 and wheelset damping elements 12. A second wheelset axle is identified by reference numeral 13.

A wheelset guide rod 14 is connected rigidly to the axle bearing housing 5 on one end and pivotably to the bogie or truck frame 2 on the other end through a wrist point 15. The wrist point 15 is displaceable horizontally but not vertically and represents a pivot point for deflections of the wheelset guide rod 14. A connecting guide rod 16 serves to couple the wheelset guide rod 14 to a compensating lever 19. To that end, the guide rod 16 is connected both to the wheelset guide rod 14 through an articulation point 17, and to the compensating lever 19 through an articulation point 18.

In the same way, a wheelset guide rod 20 is connected rigidly to the axle bearing housing 10 on one end and pivotably to the bogie or truck frame 2 on the other through a wrist point 21. The wrist point 21 is displaceable horizontally but not vertically and represents a pivot point for deflections of the wheelset guide rod 20. A connecting guide rod 22 serves to couple the wheelset guide rod 20 to the compensating lever 19. To that end, the guide rod 22 is connected both to the wheelset guide rod 20 through an articulation point 23, and to the compensating lever 19 through an articulation point 24.

A pivot point 25 of the compensating lever 19 is located centrally between the two articulation points 18, 24, and in the position of repose, in other words when the railborne vehicle is traveling straight ahead, these articulation points are oriented vertically.

As can be seen from the geometrical configuration of the connections between the wheelset guide rods 14, 20, the connecting guide rods 16, 22 and the compensating lever 19, the result when the railborne vehicle travels around curves is radial control that is symmetrical with respect to the two wheelsets. If the two wheels 4, 9 are running on the rail on the inside of the curve, then the compensating lever 19 executes a counterclockwise rotary motion about the pivot point 25, and as a result the distance between the two axle bearing housings 5, 10 decreases in comparison with the position of repose. If the two wheels 4, 9 are running on the rail on the outside of the curve, then the compensating lever 19 executes a clockwise rotary motion about the pivot point 25, and as a result the distance between the two axle bearing housings 5, 10 increases in comparison with the position of repose.

In order to damp motions brought about by track defects between the wheelset bearings and axle bearing housings, a damping element 26, for instance with a friction characteristic, is installed between the compensating lever 19 and the connecting guide rod 22. The damping element 26 is secured to the guide rod 22 through a wrist point 27 and to the compensating lever 19 through a wrist point 28. A wrist block 29 on the connecting guide rod 22 makes it easier to physically construct the wrist point 27.

As will be appreciated, the damping element 26 engages upon each rotary motion of the compensating lever 19 about its pivot point 25, and the action is double that of an articulation of the damper at the bogie or truck frame 2, because each motion of the damper wrist point 28 in one direction causes a motion of the further damper wrist point 27 in the opposite direction as a result of the lever ratios.

Figure 2:
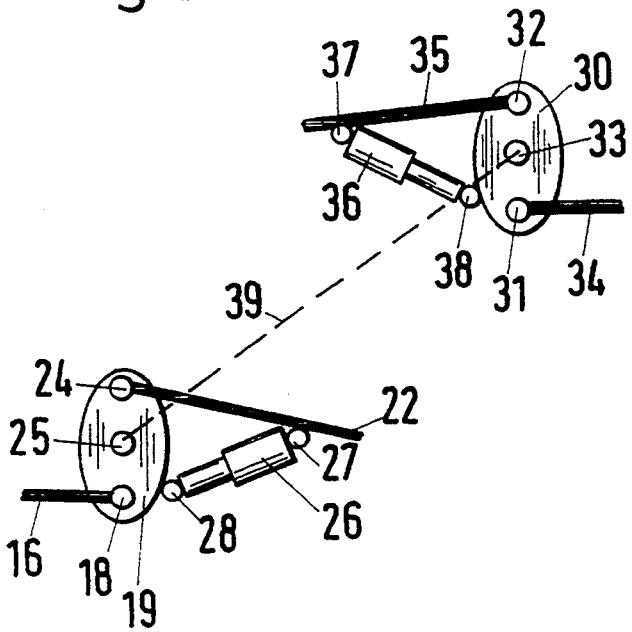
FIG. 2 is a perspective view of a variant with compensating/levers being coupled selectively with one another through a pivot shaft, on right and left halves of a bogie or truck.

FIG. 2 shows a variant with compensating levers that are coupled selectively with one another through a pivot shaft, on right and left halves of the bogie or truck. In the perspective view, both compensating levers 19, 30 of both sides of the bogie or truck can be seen. The wrist point 27 of the damping element 26 is again mounted on the connecting guide rod 22 that is secured to the compensating lever 19 through the articulation point 24. The further wrist point 28 of the damping element 26 engages the compensating lever 19 in the vicinity of the articulation point 18 serving to secure the guide rod 16.

A wrist point 37 of a damping element 36 is mounted on a connecting guide rod 35 which is secured to the compensating lever 30 through an articulation point 32. A further wrist point 38 of the damping element 36 engages the compensating lever 30 in the vicinity of an articulation point 31 serving to secure the connecting guide rod 34.

The two compensating levers may, but need not, be coupled to one another through a rigid pivot shaft 39.

In each case (whether with or without the pivot shaft) a contrary motion of the damper pistons results. In other words, the damping element 26 is compressed when the damping element 36 is extended or pulled apart, and vice versa, and as a result, possibly different friction value characteristics of the two damping elements in the two operative directions (compression, tension) are advantageously compensated for.

Figure 3:
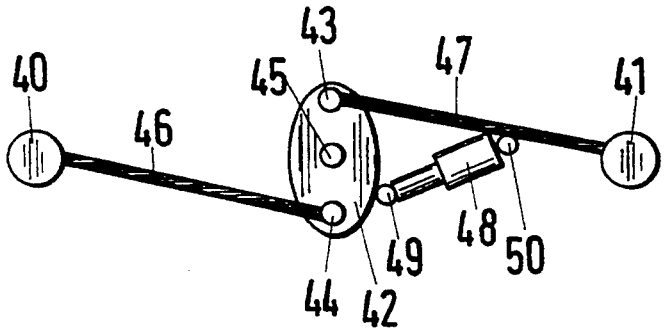
FIG. 3 is a perspective view of a running gear for a railborne vehicle that is radially adjustable through compensating levers.

FIG. 3 shows a running gear for a railborne vehicle that is radially adjustable through compensating levers. This running gear does not have the tandem guide rod construction of FIG. 1. Instead, wheelset bearing/axle bearing housings 40 and 41 are secured through respective wheelset guide rods 46 and 47 directly to articulation points 44 and 43 of a compensating lever 42. A damping element 48, for instance with a friction characteristic, is mounted on the compensating lever 42 and on the wheelset guide rod 47 through respective wrist points 49 and 50.

Naturally it is also possible to mount a further damping element in the same way between the wheelset guide rod 46 and the compensating lever 42. This configuration of additional damping elements can also be attained in the configurations of FIGS. 1 and 2.

Friction dampers or hydraulic dampers with a predetermined characteristic are used as the damping elements. Besides damping elements with a friction characteristic, damping elements with force limitation can also be used. In order to attain the desired damping characteristic, friction characteristics and force limitations may also be combined.

We claim:

1. In a railborne vehicle having at least two wheelsets, a running gear, comprising:

compensating levers for coupling the at least two wheelsets, said compensating levers each being articulated about a compensating lever pivot point; wheelset axle bearings housings:

guide rod configurations disposed between said axle bearing housings and said compensating levers for radial adjustability, said guide rod configurations including guide rods articulated at said compensating levers at a guide rod pivot point radially spaced from said compensating lever pivot point; and at least one damping element connected between one of said compensating levers and one of said guide rod configurations, said at least one damping element being articulated at a respective one of said compensating levers about a damping element pivot point radially spaced from said compensating lever pivot point and opposite said guide rod pivot point.

2. The running gear according to claim 1, wherein said guide rod configurations each have one respective wheelset guide rod between said axle bearing housings and said compensating levers, and said at least one damping element is disposed between one of said compensating levers and said one wheelset guide rod.

3. The running gear according to claim 1, wherein the vehicle has truck frames, said guide rod configurations have a tandem construction with wheelset guide rods between said axle bearing housings and the truck frames as well as connecting guide rods between said wheelset guide rods and said compensating levers, and said at least one damping element is disposed between one of said compensating levers and one of said connecting guide rods.

4. The running gear according to claim 1, wherein the vehicle has a truck with right and left sides at which said damping elements are disposed, and said damping elements on the right and left sides of the truck acting in opposite directions.

5. The running gear according to claim 1, wherein said at least one damping element has a friction characteristic.

6. The running gear according to claim 1, wherein said at least one damping element has a force limitation.

* * * * *